United States Patent [19]

Åhs

[11] Patent Number: 4,764,742

[45] Date of Patent: Aug. 16, 1988

[54] RELAY

[75] Inventor: Wilgot Åhs, Koppom, Sweden

[73] Assignee: Tocksfors Verkstads AB, Tocksfors, Sweden

[21] Appl. No.: 796,435

[22] Filed: Nov. 8, 1985

[30] Foreign Application Priority Data

Nov. 13, 1984 [SE] Sweden ..... 8405691

[51] Int. Cl.[4] ..... H01H 51/29

[52] U.S. Cl. ..... 335/142; 335/133; 335/202; 335/281; 335/297

[58] Field of Search ..... 335/133–136, 335/142, 154, 186–187, 196, 202, 296–297, 299, 281, 303, 306; 200/281, 284, 293, 302.1–302.2, 303, 275, 279; 336/219, 221

[56] References Cited

U.S. PATENT DOCUMENTS

| | | | |
|---|---|---|---|
| 2,647,188 | 7/1953 | Poitras | 335/296 |
| 3,059,156 | 10/1962 | Moriya | 335/306 |
| 3,238,344 | 4/1966 | Miachon | 200/302.2 |
| 3,869,685 | 4/1975 | Buttel et al. | 335/196 |
| 3,893,051 | 7/1975 | Shlesinger, Jr. et al. | 335/154 X |
| 4,216,453 | 8/1980 | De Feo | 335/196 X |
| 4,337,447 | 6/1982 | Lemmer | 335/202 X |
| 4,491,813 | 1/1985 | Kimpel et al. | 335/187 |

FOREIGN PATENT DOCUMENTS

| | | | |
|---|---|---|---|
| 262380 | 10/1963 | Australia | 335/196 |
| 668588 | 8/1963 | Canada | 335/154 |
| 1254248 | of 0000 | Fed. Rep. of Germany . | |
| 2320315 | 11/1974 | Fed. Rep. of Germany | 335/154 |
| 2453980 | 5/1976 | Fed. Rep. of Germany | 335/185 |
| 2622323 | 11/1977 | Fed. Rep. of Germany | 200/284 |
| 773787 | 5/1957 | United Kingdom | 200/284 |

*Primary Examiner*—Arthur T. Grimley
*Assistant Examiner*—Jane K. Lau
*Attorney, Agent, or Firm*—Cushman, Darby & Cushman

[57] ABSTRACT

Electric relay comprising one or more relay tongues, a relay contact cooperating with the respective tongue and an electromagnet actuating the respective tongue. A relay tongue unit (3) is then integral with at least one relay tongue (4), which has in one part an area reducing cross sectional dimension and is formed at its end opposite to the free end with a material cut portion (23) serving as an electric fuse. The surface of the relay contact (6) cooperating with the contact point (5) of the relay tongue is movable to a limited extent relative to this and, moreover, the electromagnet (9) actuating the relay tongue (4) consists of two composite iron plates (31, 32) electrically insulated from each other which have each, insulated from each other, an electric connection (34) integral with the iron plate, the coil (37) fed by the operating current of the electromagnet (9) being connected with one of its conducting ends (38) to one iron plate (31) and with its other end (39) to the other iron plate (32). The relay is sealed by means of a dust and moisture-proof, detachable cover means (17) having a portion (19) consisting of an elastic material, extending close to the respective relay tongue (4) and having a carrier means (20) substantially stationary relative to the relay, which carrier means is bendable with at least one part towards the portion (19) consisting of an elastic material.

9 Claims, 4 Drawing Sheets

RELAY

This invention relates to an electric relay comprising one or more relay tongues cooperating with relay contacts and operated by electromagnets.

Such relays are generally used in various electric circuits to control various functions. The fundamental structure and mode of operation of such a relay is well-known to one skilled in the art and need not be treated more in detail here.

Said type of relays contains a plurality of parts which are to be assembled to form a unit. Through the relatively complicated construction of the parts included in the relay and their mounting to form a complete relay the cost of the relay is a relatively great part of the cost of the electric circuit in which the relay is included. This is especially obvious in vehicle technique where a very great number of relays are included in the electric circuit of the vehicle. Despite mass production it has so far been very difficult to reduce the relay costs and in spite of the fact that efforts have been made all the time to reduce the manufacturing costs of such relays included in vehicles it has not been possible to reduce these relay costs drastically until with the present invention. This is feasible in that the invention has been given the characteristic features set forth in the claims, a relay being produced, the included components of which are very simple and easy to assemble to one unit, all the additional components such as fuse and resistors being omitted.

The invention will be described more in detail in the form of examples with reference to the drawing, in which FIG. 1 is a lateral schematical view of a relay in accordance with the invention.

Figure 1:
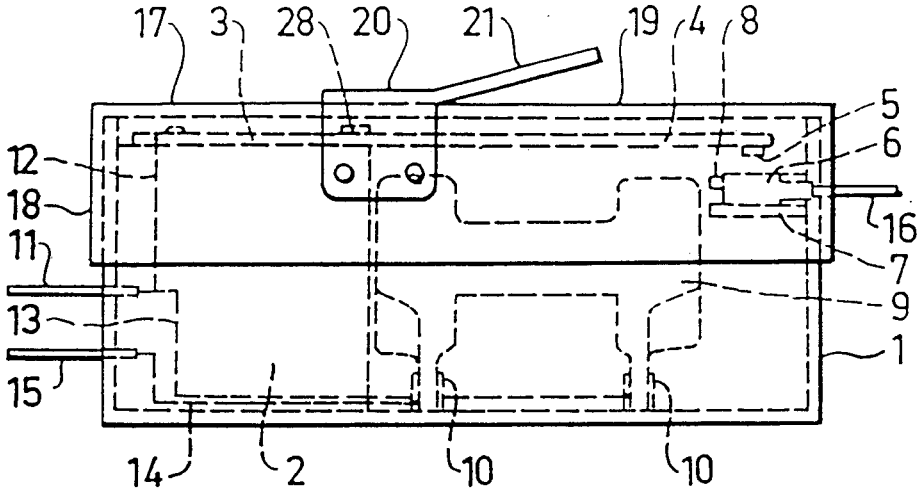
Figure 2:
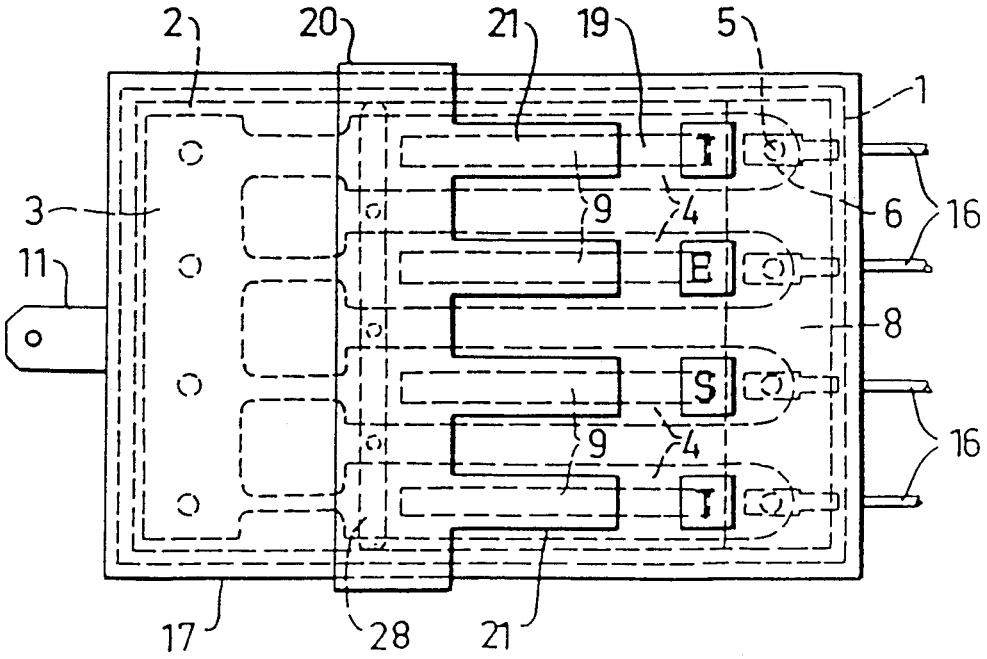
FIG. 2 is a top plan view of the relay according to FIG. 1.

The relay shown in FIGS. 1 and 2 consists of a case 1 open on top. A relay tongue unit 3 is attached to an electrically insulating bracket 2 by means of screws or rivets, which in the example shown has four relay tongues 4. This relay tongue unit will be described more in detail in the following.

In the case and in cooperation with the contact points 5 of the relay tongues 4 four relay contacts 6 are arranged. Each of these contacts 6 is supported by a socket in the form of a plane side or wall portion 7 and a second plane side or wall portion 8 provided with openings which correspond to the form of the contact elements. These sides 6 and 7 can preferably extend across the case 1 and be connected to the three connecting side walls thereof. The contact element 6 will be described more closely below.

Moreover, in the case 1 four electromagnets 9 actuating the respective relay tongue are arranged. The electromagnet 9 will be described more closely below and, as is shown in FIG. 1, its connections are inserted in flat-type pin contacts 10. As indicated in FIG. 1 a flat-type pin 11 is connected via a conductor 12 with the relay tongue unit 3 and a conductor 13 is connected with one flat-type pin contact 10. A conductor 14 starting from the other flat-type pin contact 10 is connected to a flat-type pin 15. 16 designates conductors connected to the relay contacts 6. The control current magnetizing the electromagnet 9 is thus coupled via the flat-type pins 11 and 15 while the operating current through the relay is connected between the flat-type pin 11 and the conductor 16. On top of the case 1 there is arranged a cover means 17 which is moisture and dust-proof and detachable.

This cover means 17 can in its entirety be made of a suitable elastic material which will make the edges 18 of the cover means tightly engage the relay. In this way the cover means forms a splash- and dust-tight protection of the interior of the relay. The plane upper side 19 of the cover means 17 forms the protective portion of the cover means and consists of a flexible material, preferably of the same material as the edges 18. As is clearly apparent from FIG. 1 the protective portion 19 of the cover means is immediately above the flexible relay tongues 4. A carrier means 20 is in a suitable manner attached to the cover means and can preferably consist of iron plate. In the example shown part of the carrier means is folded along the opposite sides 18 of the cover means 17 and e.g. riveted to these. At applied cover means the carrier means will be relatively immobile in relation to the relay. The carrier means 20 is formed with lugs 21, the number of which corresponds to the number of relay tongues 4 included in the relay.

The protective portion 19 of the cover means 17 has on its upper side according to FIG. 2 been provided with four fields, which have a colour contrasting to that of the protective portion and each being located above a relay tongue. In the example shown the fields have been provided with letters forming the word "TEST". If the relay fails the marked fields are pressed in a given order, the protective portion being resiliently pressed into the range of the relative marking, which means in turn that the tongue 4 is depressed against its relay contact 6. In this way it is possible to establish in a very simple and rapid manner which of the relay functions of the relay fails.

It is not possible to correct the error immediately and on the spot but the function of the relay is necessary in spite of this its function can be tolerably restored occasionally for a desired time until it is repaired or replaced, by bending down the lugs 21 of the carrier means 20 above the relay tongue 4 not in operation so as to permanently via the flexible protecting portion hold the relay tongue 4 under the lug in contact with the cooperating relay contact 6.

Figure 3:
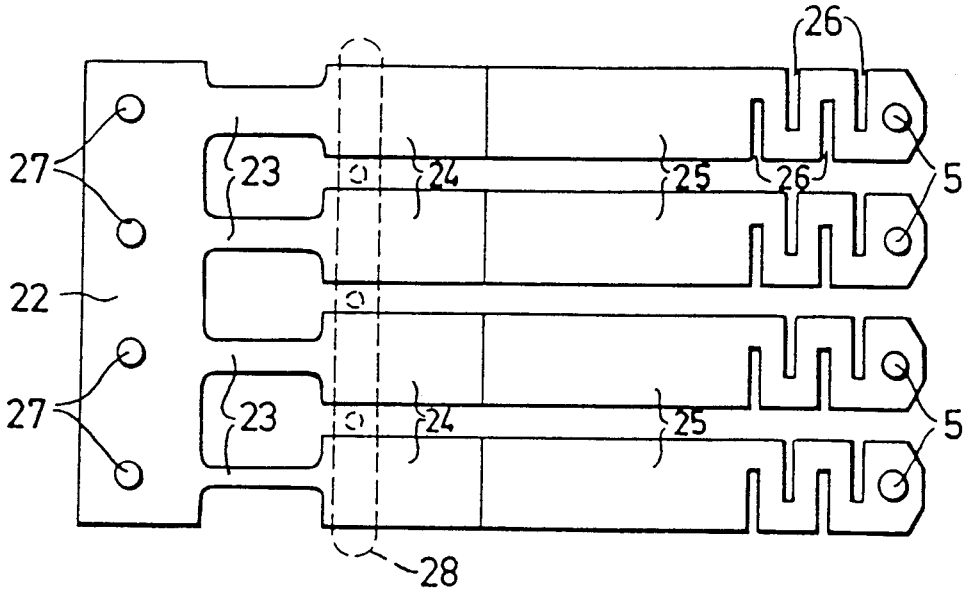
FIGS. 3 and 4 show the tongue unit included in the relay from above and from the side.
Figure 4:
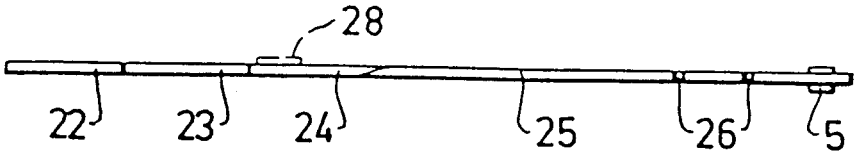
Figure 5:
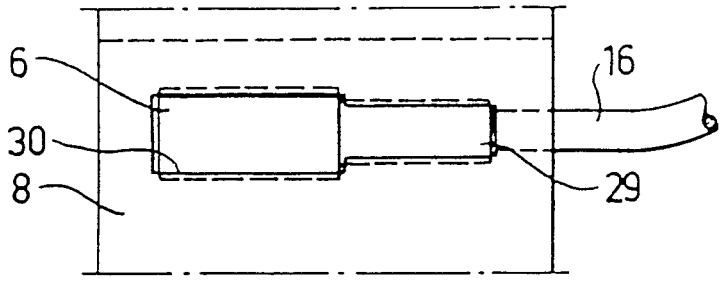
FIGS. 5, 6 and 7 show schematically one of the contact elements included in the relay as seen from above, from the side and from the end.
Figure 6:
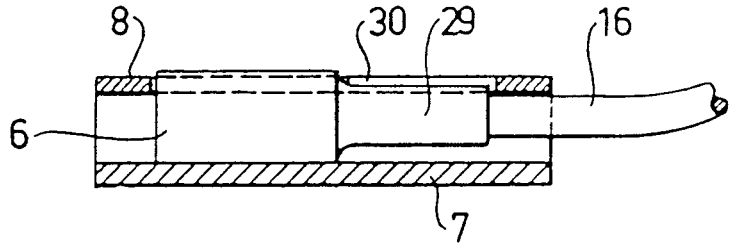
Figure 7:
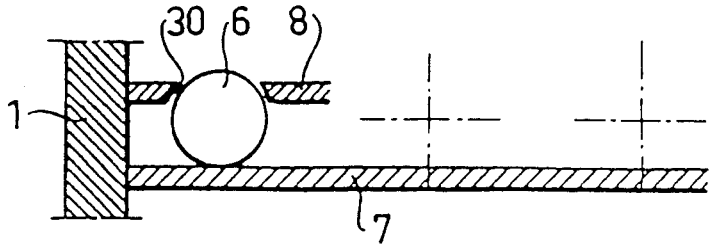

Of course the cover means may have another shape in respect of sides and protective portion within the scope of the invention and the carrier means can of course also be designed and attached to the cover means in another way than shown and In the example shown said relay tongue unit 3 consists of four relay tongues (see FIG. 3). The unit consists of an attaching member comprising a main portion 22 and in the example shown of four fuse portions 23 and four transition portions 24. Integral with the respective transition portion 24 there is arranged an extension forming four tongue portions 25 which each support a contact pin 5 at the free end.

In the example shown the attaching member (22, 23, 24) is punched from a plate of a suitable copper alloy which is suitable for the electrical conductivity purpose intended and the respective fuse portion 23 is characterized in that the material in this part has been made narrower. The conductor cross section can thus be determined here depending on the current which will be allowed to pass. In FIG. 3 an example is shown how three different values of blowing the fuse have been included in the relay tongue unit, whereby it is apparent from the figure that the two central fuse portions have the same rated value. Each tongue portion 25 consists of e.g. iron and is integral with the respective transition portion 24. The tongue portions have the same width and thickness as the transition portions. Each tongue portion is provided with four open cuts 26 alternately starting from the opposite long sides of the tongue.

In this way the material cross section is reduced along a "zigzag form" distance meaning that the respective tongue has a built-in series resistance. The main portion 22 of the attaching member has attaching holes 27 by means of which the relay tongue unit can be screwed onto the bracket 2 of the relay. Moreover, the relay tongue unit is attached by means of a clamp 28 which can be screwed onto the relay, is arranged on top of the transition portion and locks this against the bracket 2 of the relay. In this way the fuse portion 2 is prevented from being actuated by mechanical bending stresses.

If a fuse blows, i.e. is burnt off, the whole relay tongue unit can very simply be rapidly exchanged for a new unit.

The aforesaid relay contact 6 is formed from a cylindrical body and a connecting portion 29 arranged coaxially therewith, which holds fast in a suitable manner the insulated conductor 16 electrically connected coaxially with the contact element 6.

The cylindrical contact element 6 is with one mantle surface in contact with the previously mentioned plane side or portion 7 of the socket receiving the contact element. The other side is formed from a disc 8 which is provided with an opening 30. The side 8 is located at a distance greater than half the diameter of the cylindrical contact element 6 and the opening 30 is so dimensioned that the contact element is prevented from penetrating through the opening 30, simultaneously as part of the mantle surface of the contact element 6 is exposed outside the side 8. Further, the opening 30 is of a length that is somewhat greater than that of the contact element 6 with connecting portion 29. The opening 30 can be adapted to the smaller dimension of the connecting portion 29, as shown.

The contact element 6 with the socket of the invention is arranged in the relay, the mantle surface of the contact element 6 exposed outside the side 8 being intended to be touched by the contact point of the relay tongue.

As is shown and easily realized the contact element 6 is with its connecting portion easily rotatable in the socket. Due to the vibration of e.g. the vehicle, in which the relay is mounted, the contact element 6 will vibrate and turn which, in turn, means that the contact point with the contact tip of the relay tongue will move in course of time. The turning of the contact element 6 can very simply be forced by quite simply turning the conductor 16 to expose a new part of the contact element to the contact point of the relay tongue.

Figure 8:
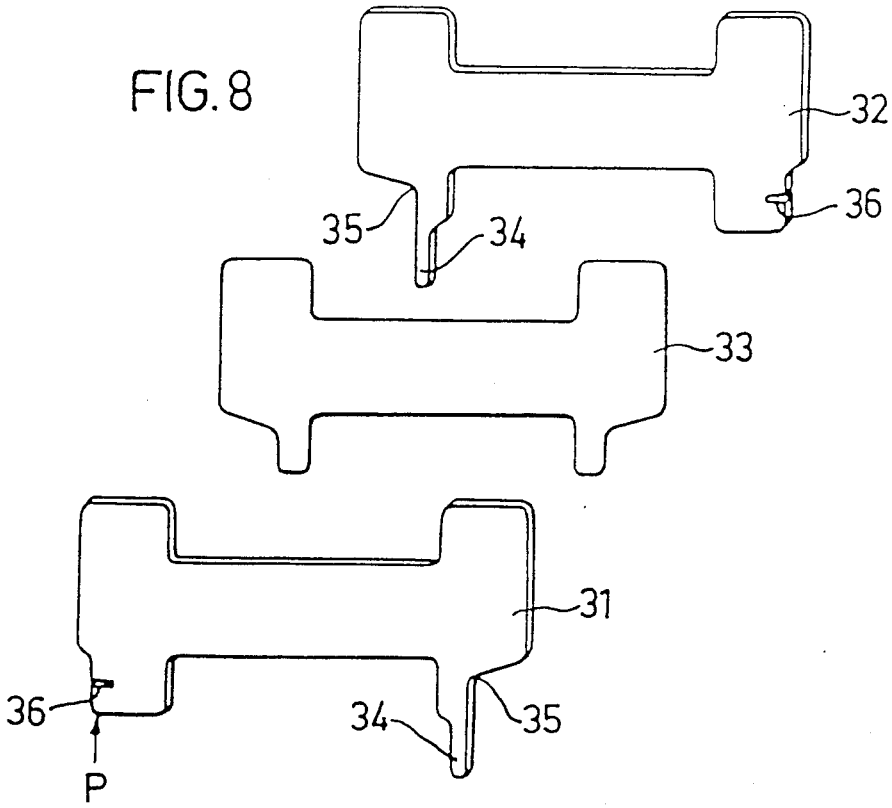
FIGS. 8 and 9 show schematically an electromagnet included in the relay taken to pieces without coil and schematically in perspective.
Figure 9:
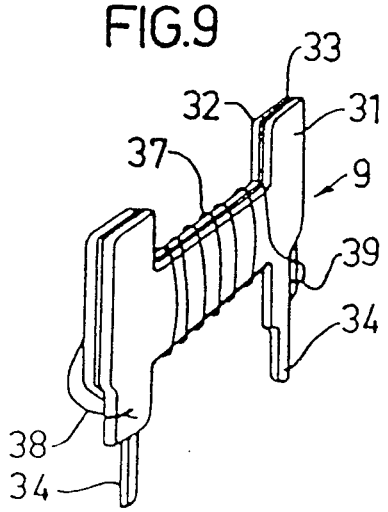
Figure 10:
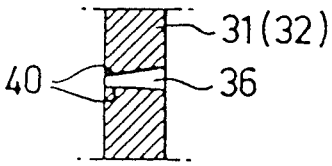
FIG. 10 shows a detail of said electromagnet.

31 and 32 designate iron plates included in said electromagnet 9 with a certain thickness chosen in suitable manner. 33 designates an electrically insulating foil, e.g. of "MYLAR". The members 31 and 32 are similar and in mirror-image relation in the mounted state of the core, as is clearly apparent from FIGS. 8 and 9. In principle the respective member has the shape of an H, the lower part of one pile being extended at 34 and forming an electrical connection there. Moreover, part of the width of the pile is cut off at 35. The lower end of the other pile of the respective member 31 and 32 has a groove 36. At mounting of the members 31 and 32 to each other with the electrically insulating layer 33 between the members the portion of the pile end of one portion provided with the groove 36 will lie outside and not be covered by the pile end of the other plate portion, which has the cut 35 at this pile end. In FIG. 9 the mounted electromagnet is shown in perspective, the coil being schematically indicated by 37. One end 38 of the coil is connected with one core member 31 and the other end 39 of the coil is connected with the other core member 32. The respective connection is arranged in such a way that e.g. the end 38 of the conductor included in the coil 37 is introduced with insulation into the groove 36, after which the material of the iron portion is upset clamping the conductor in this way. In the example shown the upsetting is preferably carried out by applying a force in the direction of the arrow P in FIG. 8. The groove 36, see FIG. 10, is formed with a wedge-like cross section, the edges 40 intersecting the insulating layer of the conductor. In this way contact is established between iron member and conductor. As the conductor at the same time, as seen in FIG. 10, projects to the right, i.e. the end of the conductor is on the left side of the iron member 31 (32), an automatical reduction of the voltage concentration of the conductor is obtained when this leaves the iron portion, which eliminates fatigue failure of the conductor at vibrations and the like.

Alternatively, the groove can be made with parallel walls as seen in cross section and the upsetting can instead be carried out with an oblique force so that the walls of the groove 36 at upsetting seen in cross section will have a direction inclined to each other. The effect will be the same as described in connection with FIG. 10.

At mounting of the electromagnet in a relay the extended connections 34 can preferably be inserted into connections intended for this, e.g. flat-type pin contacts 10 in the bottom side of the relay. The connections are then automatically connected to the control circuit (13, 14) intended for the relay. This means that one portion 31 of the very iron core forms one electrical contact of the magnetizing current of the coil 37 and the other iron portion 32 the other contact of the coil.

As is easily realized no special attachment of the magnet and special connections for the coupling of the coil are required at the mounting of the electromagnet in a relay. The electromagnet is automatically in working order directly when applied to the relay.

Instead of the connections 34 in the form of flat-type pins, which are ready directly at mounting to be pressed down into the flat-type pin contacts 10 stationarily mounted in the relay holes can e.g. be made in the bottom side of the relay and the connections be soldered to the conductors or a ready printed circuit.

What is claimed is:

1. Electric relay comprising one or more relay tongues each having a contact point located at a free end of the respective tongue, a relay contact cooperating with the contact point of each respective tongue and an electromagnet actuating the respective tongue, characterized by a relay tongue unit forming the relay tongue or tongues, the relay tongue unit being integral with at least one relay tongue which has in one part an area reducing cross sectional dimension and which at its end opposite to the free end is formed with a material cut portion serving as a fuse, that the surface of the relay contact cooperating with the contact point of the relay tongue is movable to a limited extent relative to this, that the electromagnet actuating the relay tongue includes a coil and two composite iron plates electrically insulated from each other, which have been insulated from each other an electric connection integral with the iron plate, the coil of the electromagnet fed by operating current being connected with one of its conducting ends to one iron plate and with its other end to the other iron plate, and that the relay is sealed by means of a dust and moisture-proof cover means having a portion consisting of an elastic material which portion extends close to the respective relay tongue, and a carrier means external of the cover means substantially stationary relative to the relay, which carrier means includes at least one part which is plastically deformable towards the portion consisting of an elastic material so as to deform the elastic material and to move said tongue such that the respective contact point engages the respective relay contact and to maintain such contact.

2. Electric relay according to claim 1, characterized in that the relay tongue unit has the shape of at least one resilient sheet consisting of an attaching member including a main portion, a fuse portion and a transition portion as well as a tongue portion which has a contact at its free end and is provided with a resistance portion between this contact and the transition portion, the fuse portion having a width and/or thickness substantially less than the width and/or thickness of the transition portion and the resistance portion being integral with the tongue portion and consisting of a section having a width less than the width of the tongue portion in that the tongue portion is provided with a number of open cuts starting from the long sides of the tongue portion and arranged alternately from one and the other side of the tongue portion, that the relay tongue unit is formed in one piece and that the attaching member consists of a copper alloy suitable for electric conduction purposes and the tongue portion of iron.

3. Electric relay according to claim 2, characterized in that a plurality of relay tongues are arranged beside each other with the main portions combined homogeneously in one piece with each other.

4. Electric relay according to claim 1, characterized in that the relay contact has the shape of a cylindrical body of a circular cross section and a socket permitting rotation of the body, which is arranged to uncover an arbitrary portion of a rotation-symmetrical portion of the surface of the body for contact of the contact point, a conductor connected to the body being arranged to be concentrically connected with one end of the body, and that the body is arranged between a plane side portion of the socket and another side of this, which other side is provided with an opening so dimensioned that the body with its mantle surface can partly extend through the opening.

5. Electric relay according to claim 1, characterized in that the electromagnet includes two portions electrically insulated from each other, that each portion has an electric connection and that one coil end of the coil enclosing the two portions of the core is conductively connected with one portion and the other coil end is conductively connected to the other portion, the respective portion having the shape of an H, the lower end of one pile of which forms the electrical connection of the portion, and that at the mounting of the portions to each other, with an intermediate layer electrically insulating the portions from each other, a connection is placed at the lower end of each pile.

6. Electric relay according to claim 5, characterized in that the respective electrical connection is formed as a flate-type pin contact and that the respective portion is provided with an open groove ending in one edge of the portion, in which groove the conductive end is arranged and fixed due to the fact that the material of the portion is upset in the region of the groove.

7. Electric relay according to any of the preceding claims, characterized in that the said portion of the cover means has the shape of a protective part made of a flexible material, which extends close to the relay tongues at applied cover means so that a pressure from outside by e.g. a finger on the protective portion bends down a relay tongue towards the relay contact cooperating with the relay tongue, and that the carrier means is fixedly secured to the cover means, said carrier means having lugs corresponding to the number of relay tongues, of which each optionally is plastically bendable against the protective portion and the relay tongue located below this in order to keep said tongue temporarily in contact with the relay contact.

8. Electric relay according to claim 7, characterized in that the cover means has the shape of a cover provided with, the covering upper portion of which forms the flexible protective portion.

9. Electric relay according to claim 8, characterized in that the carrier means extends between two opposite sides and is attached to these in order to form a unit substantially immobile with the relay at mounted cover means.

* * * * *